US008679303B2

(12) United States Patent
Sinha

(10) Patent No.: US 8,679,303 B2
(45) Date of Patent: Mar. 25, 2014

(54) REFILLABLE ANODE

(75) Inventor: Sunil Kumar Sinha, Houston, TX (US)

(73) Assignee: Airgenerate, LLC, Houston, TX (US)

( * ) Notice: Subject to any disclaimer, the term of this patent is extended or adjusted under 35 U.S.C. 154(b) by 355 days.

(21) Appl. No.: 12/590,793

(22) Filed: Nov. 14, 2009

(65) Prior Publication Data

US 2011/0114477 A1 May 19, 2011

(51) Int. Cl.
*C23F 13/10* (2006.01)
*C23F 13/18* (2006.01)

(52) U.S. Cl.
USPC ..... 204/196.37; 204/196.1; 204/196.23; 204/196.24; 204/196.25; 204/196.3; 204/196.31; 204/196.32; 204/196.36; 205/730; 205/731; 205/732; 205/733

(58) Field of Classification Search
USPC ..... 204/196.1, 196.23, 196.24, 196.25, 204/196.3, 196.31, 196.32, 196.36, 196.37; 205/730–733
See application file for complete search history.

(56) References Cited

U.S. PATENT DOCUMENTS

| | | | | | |
|---|---|---|---|---|---|
| 4,035,903 | A * | 7/1977 | Taggart | 29/458 |
| 4,201,637 | A * | 5/1980 | Peterson et al. | 205/731 |
| 5,728,275 | A * | 3/1998 | Twigg | 204/196.23 |
| 5,853,553 | A * | 12/1998 | Twigg | 29/825 |
| 5,855,747 | A * | 1/1999 | Lusk | 204/196.19 |
| 6,606,452 | B1 * | 8/2003 | Caine | 392/457 |
| 6,611,133 | B2 * | 8/2003 | Kean et al. | 324/71.1 |
| 6,903,540 | B2 * | 6/2005 | Kean et al. | 324/71.1 |
| 7,527,714 | B2 * | 5/2009 | Kahite et al. | 204/196.18 |
| 7,594,937 | B2 | 9/2009 | Amita et al. | |
| 7,727,362 | B2 * | 6/2010 | Bytyn | 204/196.17 |
| 7,857,949 | B2 * | 12/2010 | Closset et al. | 204/196.11 |

* cited by examiner

*Primary Examiner* — Nicholas A Smith
(74) *Attorney, Agent, or Firm* — Egbert Law Offices, PLLC

(57) ABSTRACT

A liquid heating system may comprise a metallic container and a refillable non-corrosive hollow porous tube, which may be coupled to the metallic container. The refillable non-corrosive hollow porous tube may include at least one open end and anodic material may be filled or refilled into the refillable non-corrosive hollow porous tube through the at least one open end. The anodic material is corroded by the oxidation process at a substantially faster rate compared to the metallic container. The anodic material is refilled into the refillable non-corrosive hollow porous tube through the at least one open end without removing the refillable non-corrosive hollow porous tube from the metallic container or disturbing the position of the refillable non-corrosive hollow porous tube.

19 Claims, 7 Drawing Sheets

REFILLABLE ANODE

FIELD OF INVENTION

The present invention relates to anodes used to delay or overcome the corrosion of metals used in making containers for liquid heating and more specifically relates to a refillable anode tube.

BACKGROUND OF THE INVENTION

In liquid heating systems, a metallic container such as a boiler or tank is used to store the liquid and the boiler or tank is heated to raise the temperature of the liquid. Corrosion in such liquid heating systems is a major disruptive factor. Typically, the metallic container is made of less reactive metals which have less free electrons to participate in oxidation process, thus delaying the corrosion of the metallic containers to an extent. Further, the inner surface of hot water tanks may be coated with glass or ceramic to overcome corrosion. However, to further delay the rate at which the metal containers corrode, a technique referred to as electrochemical process is used. An electrochemical process generally, refers to provisioning an anode within the metallic container. Typically, the metals used for making anodes are highly reactive compared to the metals used for making the containers. Highly reactive metals used in making anodes have more electrons available for oxidation. As a result, the anodes corrode quickly resulting in further delaying of the oxidation of the metallic container, which acts as a cathode. Anode is used for protecting a cathode as the anode further delays corrosion of cathode (metallic container).

Anode is a metallic rod, which is used in cathodic protection, where it corrodes to protect the metallic container (i.e., cathode). Usually, highly reactive metals like aluminum, magnesium, zinc, or any alloy, which are more reactive than the cathode is used as an anode. The metallic containers are generally made of less reactive metals such as steel, copper and its alloys.

In many scenarios, the liquid used in the liquid heating system may include hard water, which may comprise high amounts of dissolved minerals. While the hard water is heated, some of these dissolved minerals may precipitate on the inner surface of metallic container to form a hard layer rigidly attached to the inner surface of the metallic container. The hard layer may decrease the transfer of heat and increase the amount of heat required to raise the temperature of the liquid to a preset level. Such hard layer formation may reduce the efficiency of the liquid heating system. Also, the hard layer may corrode the inner surface of the metallic container.

Anodes are generally provided in the form of rods and the rods are fitted into the metallic container. For example, the anode rod is secured tightly to the lid of the metallic container. The top end of the anode rod is provided with external threads and the lid is provided with the internal threads to fix the anode rod firmly to the lid. The anode rods corrode at a much faster rate to further delay the corrosion of the metallic container and the anode rods are to be replaced more frequently compare to the metallic container. Unfortunately, the external threads provisioned on the top end of the anode rod may also get corroded. The liquid heating system has to be halted before replacing the anode rods at frequent intervals. In residential setup, the service cost to replace the anode may be high and mostly the anode rods may not replaced, which is the major cause for liquid heater tank failures. Halting the liquid heating systems may cause downtime in an industrial setup, disrupting the operations of the industry, which may lead to decreased productivity and sub optimal use of resources. Another challenge is that of removing such anode rods without damaging the internal threads of the lid as the external threads on the top end of the anode rod are corroded.

BRIEF DESCRIPTION OF DRAWINGS

The invention described herein is by way of example and not by way of limitation in accompanying figures. For simplicity and clarity of illustration, elements in the figures here are not necessarily drawn to the scale. For example, the dimensions of some elements may be magnified when compare to other elements for clarity. Further, where considered appropriate, reference labels have been repeated among the figures to indicate corresponding or similar elements.

DETAILED DESCRIPTION

The following description describes a refillable anode. In the following description, numerous specific details and choices are set forth in order to provide a more thorough understanding of the present invention. It will be appreciated, however, by one skilled in the art that the invention may be practiced without such specific details. In other instances, constructional details and other such details have not been shown in detail in order not to obscure the invention. Those of ordinary skill in the art, with the included descriptions, will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that, it is within the knowledge of one skilled in the art to affect such feature, structure, or characteristic in connection with other embodiments whether or not explicitly described.

Figure 1:
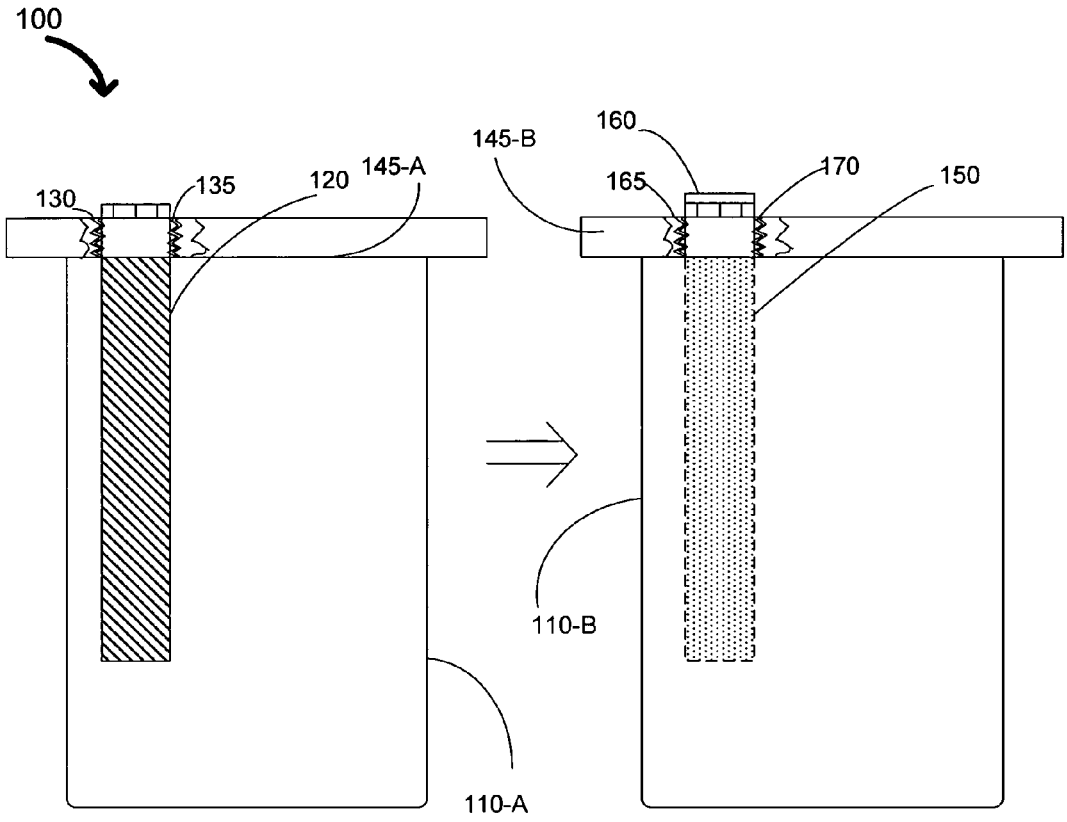
FIG. 1 illustrates an arrangement 100, in which a refillable anode may be used in accordance with an embodiment.

In one embodiment, the refillable anode tube may be used in any system in which corrosion may happen ("corrodible systems" hereafter) to delay or overcome corrosion. Corrodible systems may include liquid heating systems, gas and liquid storage systems, and any other such systems. The description is continued with liquid heating system as an example, however, the refillable anode tube may be used in other scenarios in which corrosion is anticipated. An embodiment of a liquid heating system arrangement 100, which may use a refillable anode, is illustrated in FIG. 1. The arrangement 100 may comprise a first metallic container 110-A including a conventional anode 120 and a second metallic container 110-B that may include a refillable anode rod 150. The metallic container 110-A comprises a lid 145-A to which a removable solid anode rod 120 is fitted with. The anode rod 120 may be made of anodic material such as aluminum, magnesium, zinc or any such similar reactive metals. While liquid is filled into the metallic container 110-A and heated, the anode rod 120 offers more electrons that cause oxidation (or corrosion) of the anode rod 120. The anode rod 120 is provided to delay the oxidation (i.e., corrosion) of the metallic container 110-A. The anode rod 120 is replaced at regular intervals based on the time period taken for the anode rod 120 to be corroded.

The anode rod 120 usually includes a top end, which has external threads 130 to fit into internal threads 135 provided in the lid 145-A to allow the anode rod 120 to be securely fastened to the lid 145-A. With the ongoing oxidation of the anode rod 120, the external threads 130 and possibly the internal threads 135 of the lid 145-A may corrode (rust). While replacing the anode rod 120, the liquid heating system of the metallic container 110-A is halted (referred to as down time) and such downtimes, especially, in an industrial scenario is not desirable. In addition to such downtimes, replacing the anode rod 120 may itself present a challenge due to the corroded internal threads 135 and external threads 130.

To overcome the above stated challenges, the anode rod 120 may be substituted or replaced with a refillable anode 150. In one embodiment, the refillable anode 150 may be made of non corrosive material such as ceramics, glass, hybrid or high temperature plastic, or any other non metallic material which is non corrosive. In one embodiment, the non corrosive refillable anode 150 may be hollow inside and may include a closed bottom and an open top end. In one embodiment, the non corrosive refillable anode 150 may include multiple pores on its surface. In one embodiment, the top end may comprise external thread 170 that may be used to secure the refillable anode 150 to the lid 145-B. In one embodiment, the top end may extend above the lid 145-B to allow a removable cap 160 to be used to close the opening at the top end. In other embodiment, the cap 160 may be press fit to cover the opening at the top end. All non-metallic tube will have pores for ions to transfer. The pores may be of micron level to visible holes.

In one embodiment, the refillable anode tube 150 may be filled in with anodic material. In one embodiment, the anodic material may be in the form of powder, granules, cut piece, wires, cut pieces of wires, small balls and in such other similar shapes. In one embodiment, the anodic material may be easily filled into the refillable anode tube 150 by opening the removable cap 160. In one embodiment, the refillable anode tube 120 may not be replaced at regular intervals at all. However, the corroded anodic material within the refillable anode tube 150 may be replaced at regular intervals with fresh anodic material. In one embodiment, provisioning a refillable anode tube such as the anode tube 150 described above may substantially decrease the downtimes, which may cause improved productivity in an industrial scenario. Also the use of refillable anode tube may substantially eliminate the difficulties associated with removal of the anode rod 120 described above.

In one embodiment, the refillable anode tube 150 may be coupled to the metallic container 110, which may be used for storing and heating of liquid. The metallic container 110 may be provided with electrical heating, gas heating, heat pump liquid heating, solar heating, or any other such heating mechanisms.

Figure 2:
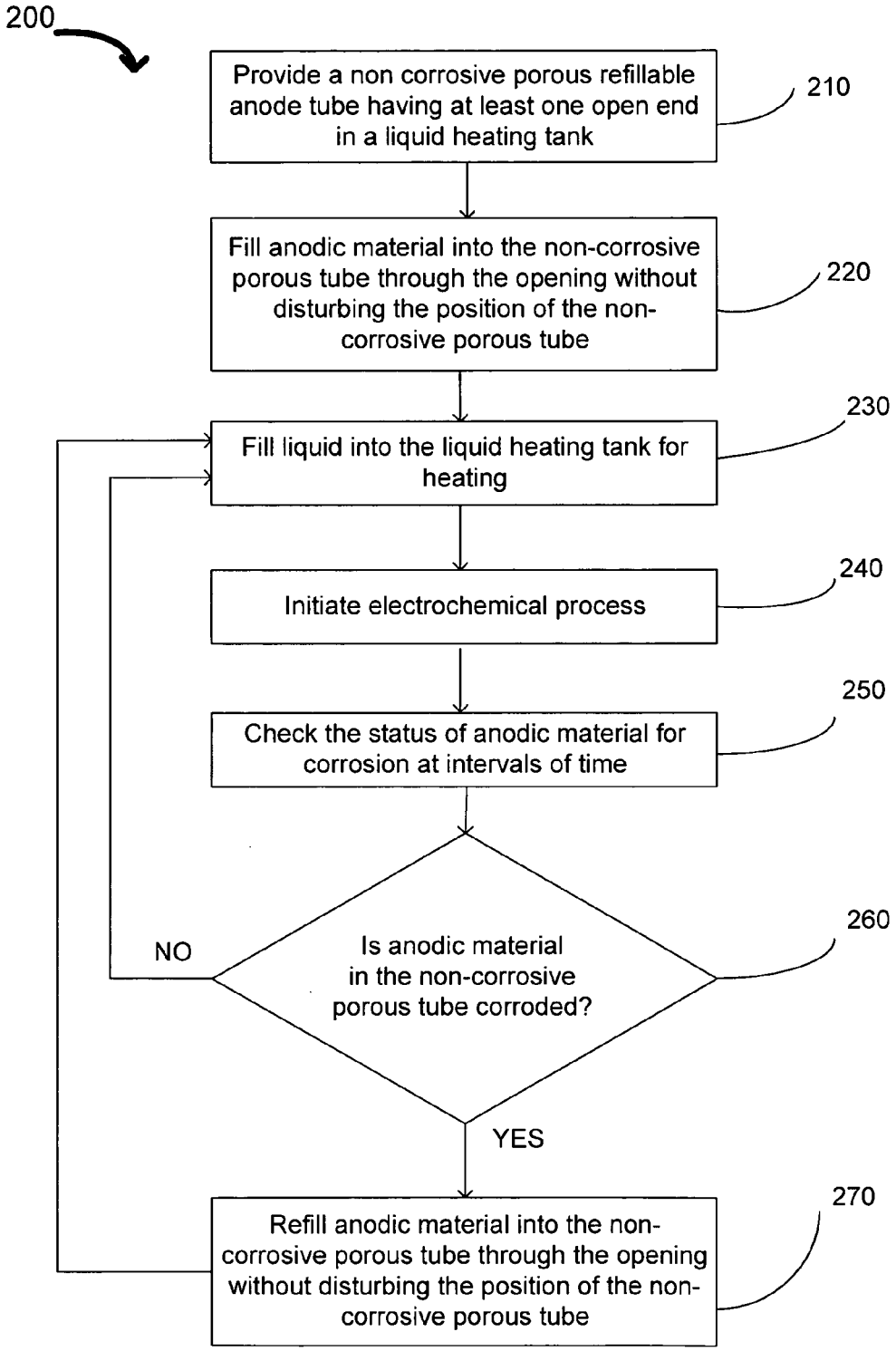
FIG. 2 is a flow chart illustrating an operation of the refillable anode in accordance with an embodiment.

An embodiment of an operation of the arrangement 100 including the refillable anode is illustrated in a flow chart of FIG. 2. In block 210, a non corrosive refillable anode tube 150 having at least one open end may be fitted into the metallic container 110-B. in one embodiment, the open end may be provided at the top of the refillable anode tube 150. In one embodiment, the top end of the refillable anode tube 150 may be provided with external threads to allow secure fastening to the lid 145-B and to allow the removable cap 160 to be mounted on the anode tube 150 to close the open end.

In block 220, the refillable anode tube 150 may be filled with the anodic material by removing the removable cap 160 of the refillable anode tube 150, which is provisioned on the top of the anode tube. In one embodiment, the anodic material may be filled without removing or disturbing the position of the non-corrosive refillable anode tube 150.

In block 230, liquid is allowed to flow into the metallic container 110-B and the liquid heating operation may be started by providing supply of source. In one embodiment, source supply may be derived from an electric source, a gas source, or a heat pump liquid heating source and such other sources.

In block 240, an electrochemical process may be initiated. In one embodiment, the electrochemical process may delay corrosion of the metallic container 110-B. However, the anodic material within the porous, non-corrosive refillable anode tube 150 may undergo oxidation process and in the process the anodic material may be corroded to protect the corrosion of the metallic container 110-B.

In block 250, the status of the anodic material may be checked at regular intervals to ensure that the anodic material is not substantially corroded. In one embodiment, the status of the anodic material may be checked once in three months or at any suitable intervals of time. In block 260, control passes to block 270 if the anodic material is corroded and to block 230 otherwise.

In block 270, refill by the anodic material into the refillable anode tube 150 after emptying the corroded anodic material in the refillable anode tube 150. In one embodiment, the anodic material that may be corroded is emptied by opening the removable cap 160 and taking out the corroded anodic material. In one embodiment, the corroded anodic material may be emptied once in two years. In one embodiment, after emptying the corroded anodic material, the new anodic material is refilled without disturbing the position or removing the refillable anode tube 110-B.

Figure 3:
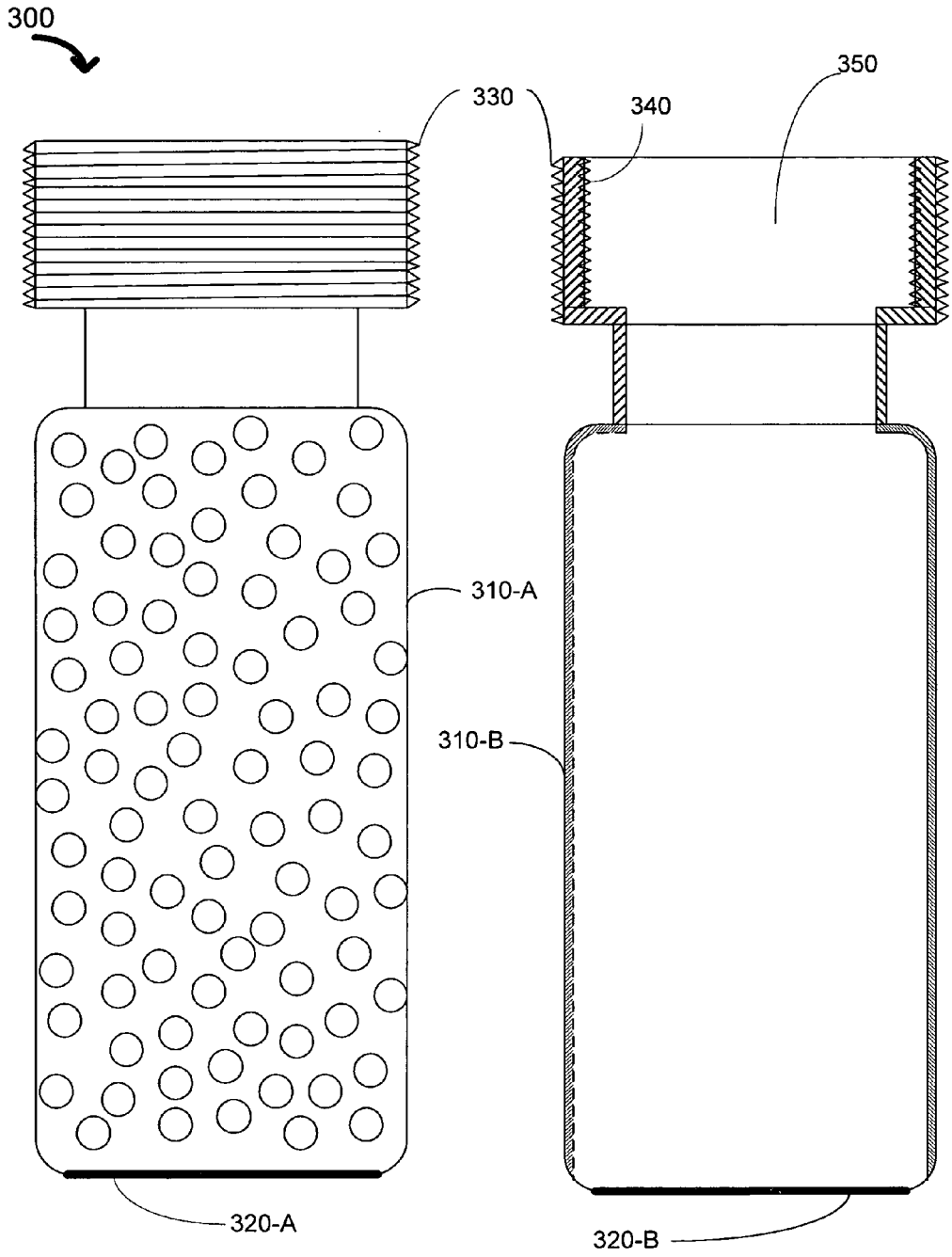
FIG. 3 illustrates the construction details of the refillable anode in accordance with an embodiment.

In an embodiment, the constructional details of refillable anode tube 150 are illustrated in FIG. 3. The refillable anode tube 150 is shown in front view and cut sectional view for better understanding purpose. The body of refillable anode tube 310-A may be made of non-corrosive material such as ceramic, glass, hybrid or high temperature plastic, porcelain, or any other non-corrosive non metallic material. The refillable anode tube 150 may be flexible and porous. The dimension of the pores may vary from one micron to many millimeters. In one embodiment, the size of the anodic material may be greater than the dimension of the pores.

In one embodiment, a bottom 320 of the refillable anode tube 150 may be closed and non porous to have better strength for the refillable anode tube 150. The external threads 330 are provisioned on the top end of the anode tube 150. Internal portion of the top end of the refillable anode tube 150 may be provided with internal threads 340 for the removable cap 160 to fit in, or the removable cap 160 may be fitted to the extended external threads 330 or the removable cap 160 may be of press fit type as well. The external threads 330 provided on the refillable anode tube 150 are used to screw fit the refillable anode tube 150 to the lid 145-B of the metallic container 110-B. The anodic material may be filled through the opening 350 by removing the removable cap 160. In one embodiment, the removable cap 160 used to close the opening 350 may be made of non corrosive material as well. The outer diameter of the refillable anode tube 150 may be ¾th inch outside diameter of metallic container 110-B, for typical residential hot water tank and bigger for commercial and industrial liquid boilers or tanks. In one embodiment, the diameter of the metallic container 110-B may measure 20 inches and the diameter of the refillable tube 150 may vary between 0.5 inches and 2.562 inches In one embodiment, the thickness of the refillable anode tube 150 may be selected to withstand the wear and tear and breakage in the normal operating condition. Diameter of the metallic container 110-B, may be 20 inches or bigger than 20 inches to several feet.

Figure 4A:
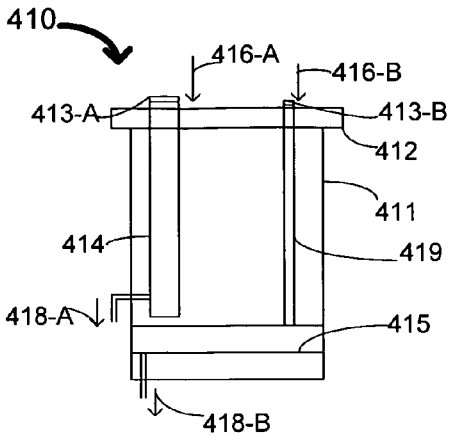
FIGS. 4(*a*) to 4(*e*) illustrate various embodiments of refillable anode.

In one embodiment, the refillable anode tube 150 may be arranged in various positions and combinations. An embodiment illustrating a combination of individual vertical and horizontal refillable anode tube provisioned in a metallic container is depicted in FIG. 4(A). A combination of vertical refillable anode tube 414 and a horizontal refillable anode tube 415 may be provisioned in the metallic container 411 to delay or to overcome the corrosion along the vertical and horizontal surfaces the metallic container 411. In one embodiment, the refillable anode tube 414 may be positioned vertically such that the axis of the refillable anode tube 414 may be parallel to the wall of the metallic container 411, and the refillable anode tube 415 may be positioned such that the axis of the horizontal anode tube 415 may be parallel to the lid 412. The vertical refillable anode tube 414 may be filled with the anodic material by removing the removable cap 413-A provisioned at the top of the refillable anode tube 414. The horizontal refillable anode tube 415 may contain an inlet tube 419 for filling the anodic material provisioned with a removable cap 416-B. The inlet tube 419 may be made of the non corrosive material, which may be similar to the material (e.g., ceramic, glass, hybrid or high temperature plastic) used for making the vertical refillable anode tube 414 or the horizontal refillable anode tube 415. The inlet tube 419 may also contains pores which may contribute to delaying of corrosion of the metallic container 411. In one embodiment, the corroded material may be drained out of the refillable anode tubes 414 and 415, respectively, through the drain valves 418-A and 418-B.

Figure 4B:
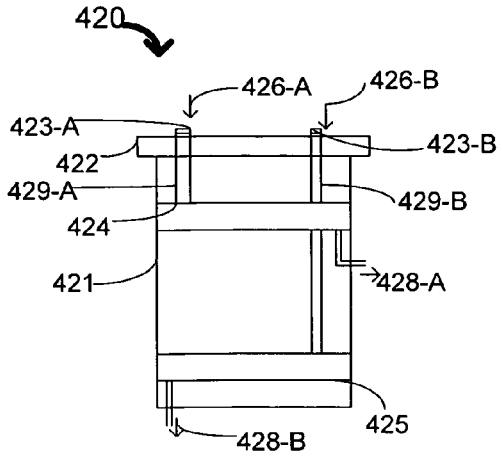

An embodiment illustrating a combination of at least two horizontal refillable anode tubes 424 and 425 provisioned in a metallic container is depicted in FIG. 4(B). In one embodiment, the axis of the refillable horizontal anode tubes 424 and 425 may be parallel to the bottom or the top plate of the metallic container 421 or the axis of the refillable horizontal anode tubes 424 and 425 may be perpendicular to the wall of the metallic container 421. In one embodiment, the horizontal anode tubes 424 and 425 may, respectively, comprise inlet tubes 429-A and 429-B. In one embodiment, the inlet tubes 429-A may be provisioned with a removable cap 426-A and a drain out valve 428-A to, respectively, fill in the anodic material and to drain out the corroded anodic material. In one embodiment, the inlet tubes 429-B may be provisioned with a removable cap 426-B and a drain out valve 428-B to, respectively, fill in the anodic material and to drain out the corroded anodic material.

Figure 4C:
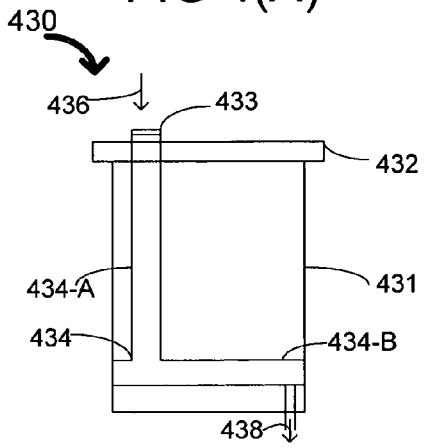

An embodiment illustrating a single refillable anode tube 434 comprising at least one vertical member 434-A and a horizontal member 434-B provisioned in a metallic container is depicted in FIG. 4(C). In one embodiment, the single refillable anode tube 434 may be formed in the shape of an inverted "T" shape or an "L" or any other such shapes. The anodic material may be filled into the single refillable anode tube 434 through an inlet covered by a removable cap 433 provisioned at the top of the single refillable anode tube 434. The corroded anodic material may be removed by the drain valve 438 provisioned at the bottom of the single refillable anode tube 434.

Figure 4D:
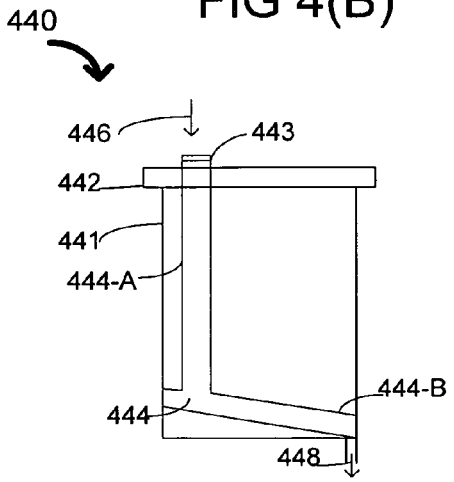

An embodiment illustrating a refillable anode tube 444 comprising a first member 444-A and a second member 444-B provisioned in a metallic container is depicted in FIG. 4(D). In one embodiment, the first member 444-A may be provisioned at an angle with reference to the top lid 442 and the second member 444-B may be provisioned at an angle with reference to the wall of the metallic container. The anodic material may be filled into the refillable anode tube 444 by removing the removable cap 443 provisioned at the top of the refillable anode tube 444. The corroded anodic material may be removed through a drain valve provisioned at the bottom of the refillable anode tube 444.

Figure 4E:
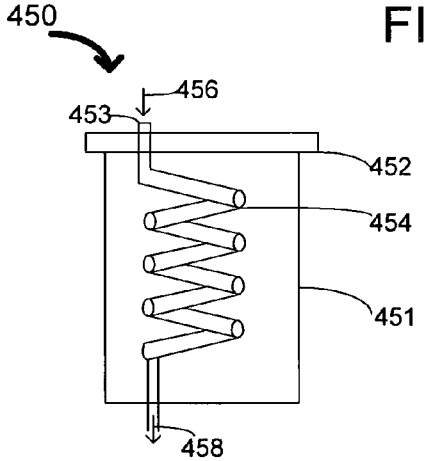

An embodiment illustrating a spiral refillable anode tube 454 provisioned in a metallic container is depicted in FIG. 4(E). In one embodiment, the spiral refillable anode tube 454 may be made in the form of a spiral along the vertical axis of the metallic container 451. The spiral refillable anode tube 454 may be fitted to the lid 452 of the metallic container 451. The spiral refillable anode tube 454 may be provisioned with a removable cap 453 at the top portion of the spiral refillable anode tube 454 for filling the anodic material. The bottom of the spiral refillable anode tube 454 may be provisioned with the drain valve 458 to drain out the corroded anodic material.

In one embodiment, the metallic container such as 110-B, 411, 421, 431, 441 and 451 may be manufactured by folding a metallic sheet and the edges of the metallic sheet may be welded to form a cylindrical structure and the top and bottom of the cylindrical structure may be sealed. However, the chances of corrosion along the welded edges may be substantially high. A refillable anode tube may include members (vertical, substantially vertical, angled, horizontal, substantially horizontal, angled) to delay or overcome the corrosion of the welded edges and the inner surfaces including the bottom and top surfaces of the metallic container 110-B. For example, if the metallic container 110-B is used as a container in a liquid heating system, the scale (hard coating of metal oxides formed on the inner walls of the metallic container 11-B) may be formed on the inner bottom surface of the metallic container 110-B at a faster rate compared to other inner surfaces of the metallic container 110-B. Formation of scale on the inner surfaces of the metallic container 110-B may reduce the amount of heat transferred to the liquid within the metallic container 110-B. As the result, more energy may be drawn from the heating source and thus the cost of liquid heating may increase.

In one embodiment, to delay the formation of scale on the inner bottom surface of the metallic container 110-B, a refillable anode may be positioned in a horizontal or substantially horizontal position with the axis of the refillable anode tube being in parallel to the bottom surface or top surface of the metallic container 110-B. In one embodiment, the refillable anode tube 150 may be hollow to hold the anodic material and the body 310-A of the refillable anode tube 150 may be porous, so that the anodic material would come in contact with the liquid in the metallic container 110-B to start the electrochemical process. After the anodic material inside the refillable anode tube 150 comes in contact with the liquid such as water oxidation process begins.

Figure 5:
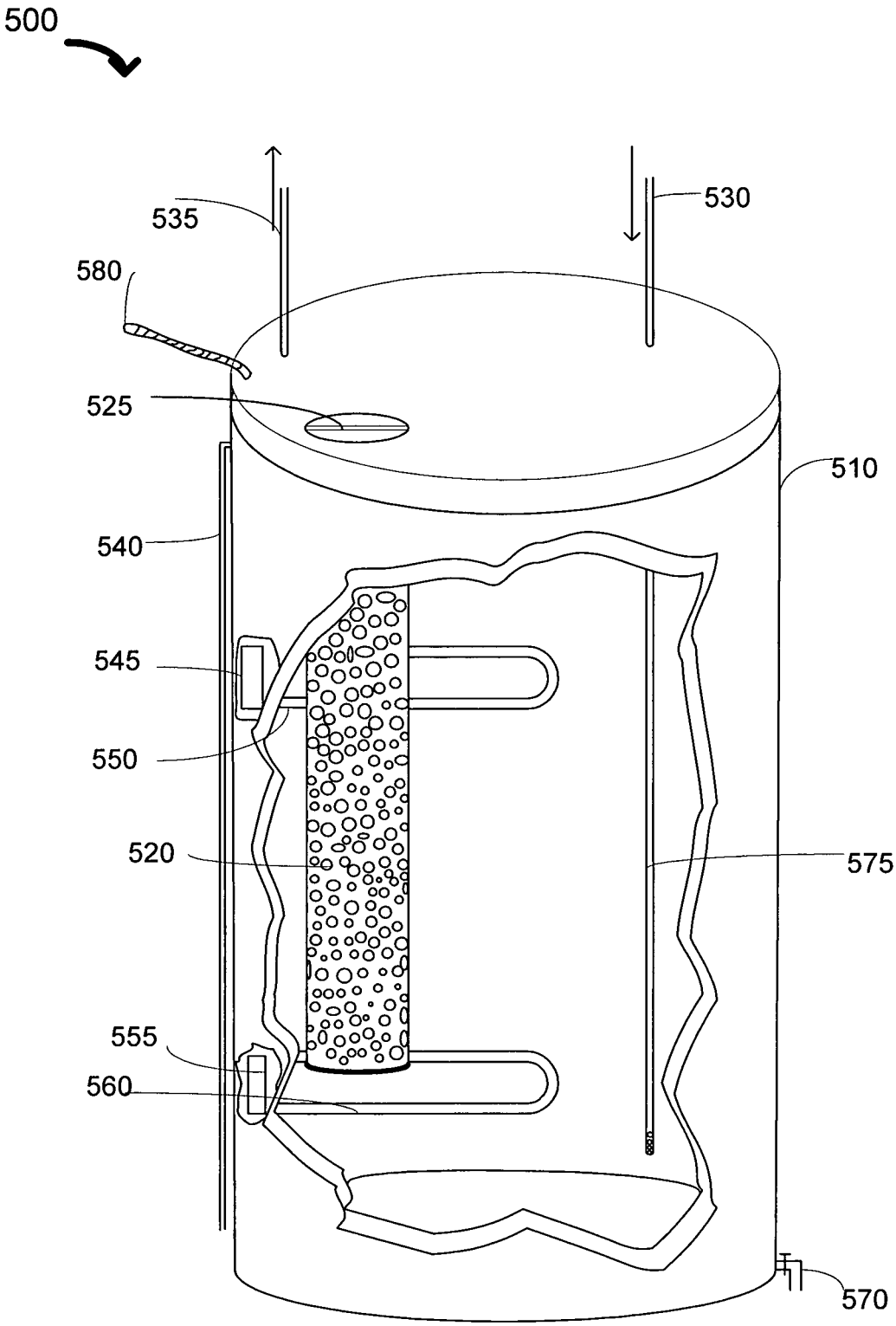
FIG. 5 illustrates an electric liquid heater fitted with the refillable anode in accordance with an embodiment.

An embodiment of an electric liquid heater 500, which may be fitted with anode tube such as the refillable anode tube 520 is illustrated in FIG. 5. The electrical liquid heater 500 is connected to the electrical supply 580, where the liquid is heated through the electrical coils 550 and 560 (upper and lower). The refillable anode tube 520 is fitted into the metallic container 510. The top portion of refillable anode tube 520 is provisioned with an opening, which is closed by the removable cap 525. The opening is used to refill the refillable anode tube 520 with the anodic material without removing the refillable anode tube 520 out of metallic container 510 or disturbing the position of the refillable anode tube 520. The metallic container 510 may comprise a cold water inlet 535, a hot water outlet 530, a pressure relief valve and overflow pipe 540. In one embodiment, the upper and lower thermostat 545 and 555 may be used to sense the temperature for heating the liquid to a predetermined temperature. The arrangement comprises of the dip tube 575 and the drain valve 570.

In one embodiment, the refillable anode tube 520 is screw fitted into the lid of the metallic container 510. In one embodiment, the refillable anode tube 520 may be flexible enough such that, a longer refillable anode tube 520 may curl at the bottom of the metallic container 510. The corrosion of anodic material in the refillable anode tube 520 may further delay the corrosion of the metallic container 510. The dip tube 575 may be connected to the cold water inlet 530, which may allow water to the bottom of the tank, as the tendency of hot water is to move upwards. The thermostats 545 and 555 (upper and lower) may sense the temperature of the liquid in the tank and use the temperature levels to signal the control unit.

Figure 6:
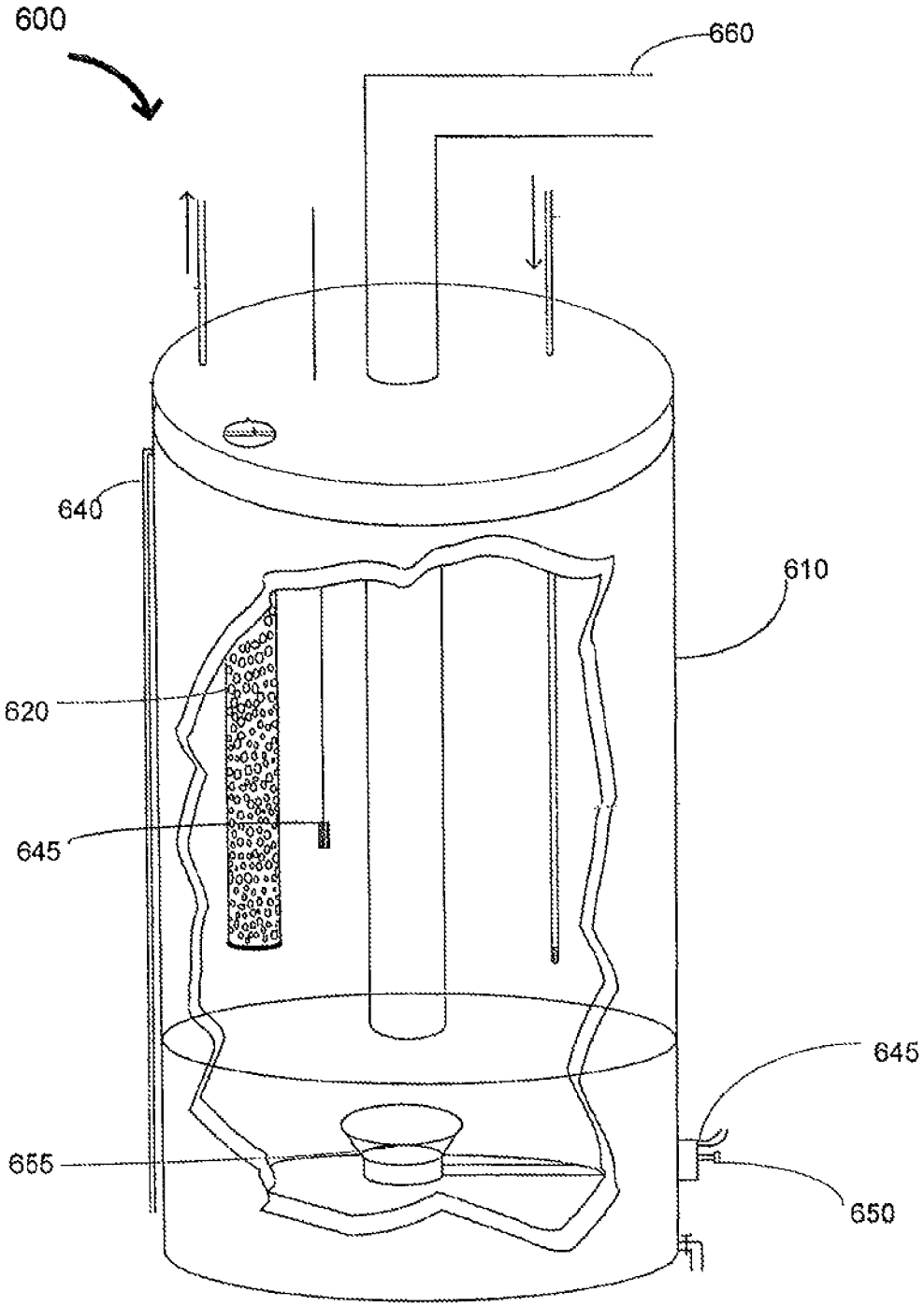
FIG. 6 illustrates a gas liquid heater fitted with the refillable anode in accordance with an embodiment.

An embodiment of a gas liquid heater 600, which may be fitted with the refillable anode tube 620 is illustrated in FIG. 6. The metallic container 610 may comprise a refillable anode tube 620, which may be similar to the refillable anode tube 150 of FIG. 1, a gas burner 655, a gas control valve 650, a gas supply 645 and a vent 660 for the burnt gases to exhaust. In this arrangement, the refillable anode tube 620 may be maintained just above the bottom as the temperature levels of the bottom of the metallic container 610 may melt down or spoil the refillable anode tube 620. In one embodiment, the refillable anode tube 620 may be filled and refilled with anodic material without disturbing the position of the refillable anode tube 620 or without removing the refillable anode tube 620.

Figure 7:
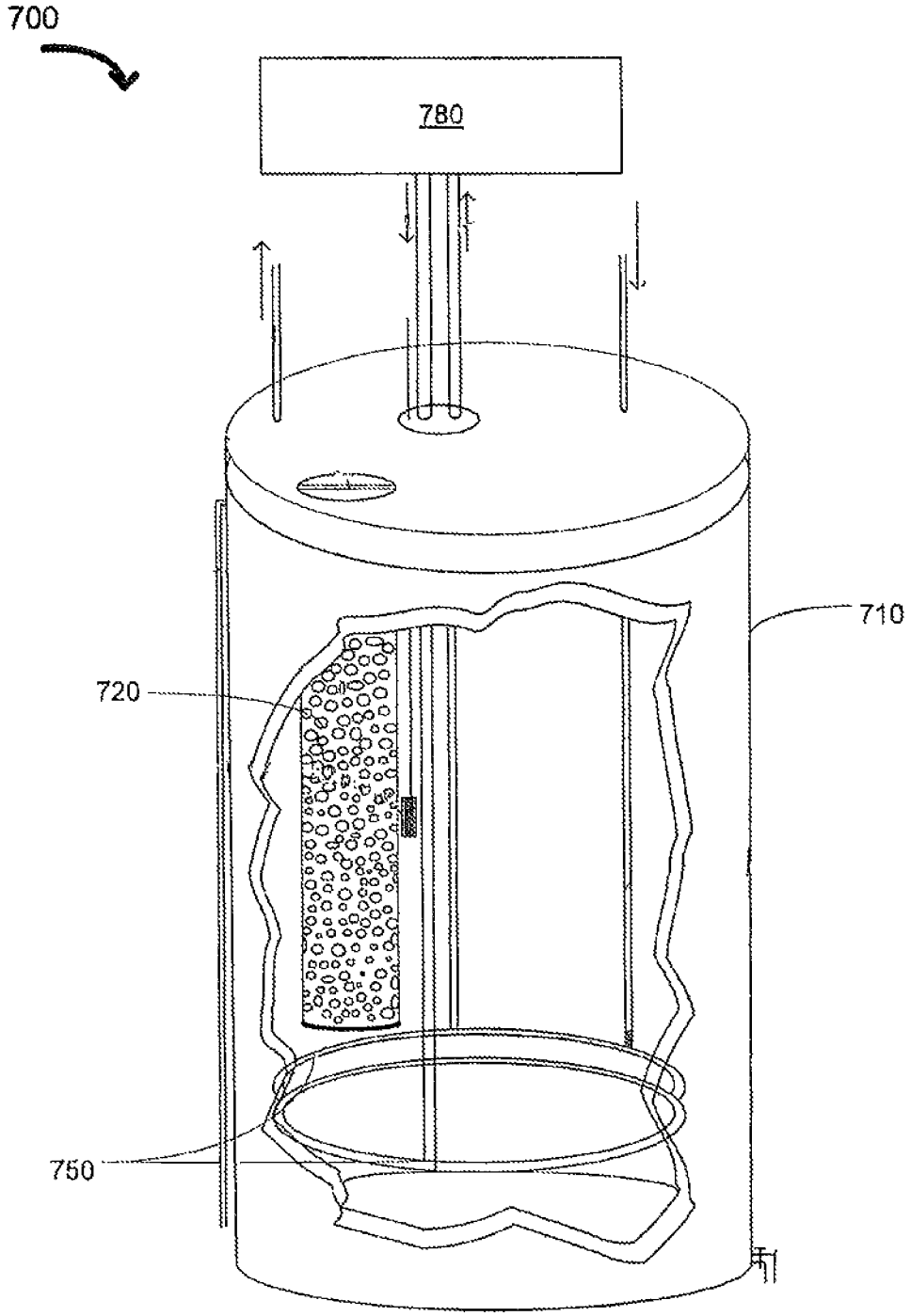
FIG. 7 illustrates a heat pump liquid heater fitted with the refillable anode in accordance with an embodiment.

An embodiment of the heat pump liquid heater 700, which may be fitted with the refillable anode tube 720 is illustrated in FIG. 7. In one embodiment, the heat pump liquid heater 780 may be coupled to the metallic container 710 and may be used for liquid heating. In one embodiment, the refillable anode tube 720 may be fitted into the metallic container 710 as described above in FIGS. 1 and 5. In one embodiment, the liquid is heated by passing the hot refrigerant in to the condenser 750, which is submerged in the metallic container 710.

In embodiment, the frequency of checking and filling of anodic material into refillable anode tube may vary between less than a year to several years depending upon the liquid used and impurities present in liquid, which is used in the metallic container 110-B, such as, hard water. The frequency of checking and filling of anodic material into refillable anode tube may precisely two years once. The main advantage of the refillable anode tube are; there may be no need to take out the refillable anodic tube for refilling the anodic material, cap is removed which is provisioned at the top of the anode tube and refill the anodic material into the hollow porous tube. This arrangement may save time and it may be economical compared to the conventional replaceable type of anode rods. As the refillable anode tube is made of non corrosive material, the threads will not be corroded and the risk of spoiling the threads of metallic container lid may also be avoided, thus replacing of lid can be avoided, which may save money.

While the invention has been described with reference to a preferred embodiment, it will be understood by one of ordinary skill in the art that various changes may be made and equivalents may be substituted for elements thereof without departing from the scope of the present invention. In addition many modifications may be made to adopt a particular situation or material to the teachings of the present invention without departing from the essential scope thereof. Therefore, it is intended that the invention not be limited to the particular embodiments disclosed as the best mode contemplated for carrying out this invention, but that the invention will include all of the embodiments falling within the scope of the appended claims.

Various features and advantages of the present invention are set forth in the following claims.

What is claimed is:

1. A corrodible system comprising: a metallic container, and a refillable non-corrosive hollow porous tube coupled to the metallic container, wherein the refillable non-corrosive hollow porous tube includes at least one open end, wherein an anodic material is filled into the refillable non-corrosive hollow porous tube through the at least one open end, wherein the anodic material is corroded by the oxidation process at a substantially faster rate compared to the metallic container, wherein the anodic material is refilled into the refillable non-corrosive hollow porous tube through the at least one open end without removing the refillable non-corrosive hollow porous tube from the metallic container, and wherein the refillable non-corrosive hollow porous tube is made of non-metallic material.

2. The corrodible system of claim 1, wherein the refillable non-corrosive hollow porous tube is flexible.

3. The corrodible system of claim 1, wherein the refillable non-corrosive hollow porous tube is made of ceramic material.

4. The corrodible system of claim 1, wherein the refillable non-corrosive hollow porous tube is made of glass.

5. The corrodible system of claim 1, wherein the .refillable non-corrosive hollow porous tube is made of hybrid plastic.

6. The corrodible system of claim 1, wherein the refillable non-corrosive hollow porous tube is made of high temperature plastic.

7. The corrodible system of claim 1, further comprising a removable cap coupled to the at least one open end, wherein the anodic material is filled into the refillable non-corrosive hollow porous tube by removing the cap.

8. The corrodible system of claim 1, wherein the refillable non-corrosive hollow porous tube is mounted vertically along a length of the metallic container.

9. The corrodible system of claim 1, wherein the refillable non-corrosive hollow porous tube is mounted in the firm of a spiral within the metallic container.

10. The corrodible system of claim 1, wherein the refillable non-corrosive hollow porous tube has an inverted "T" shaped structure.

11. The corrodible system of claim 1, wherein the refillable non-corrosive hollow porous tube has an "L" shaped structure.

12. The corrodible system of claim 1, wherein the refillable non-corrosive hollow porous tube includes a first member and a second member, wherein the first member is mounted vertically along a length of the metallic container and the second member is mounted horizontal to a wall of the metallic container.

13. The corrodible system of claim 1, wherein the refillable non-corrosive hollow porous tube includes a first member and a second member, wherein the first member is mounted substantially vertically along a length of the metallic container and the second member is mounted substantially horizontal to a wall of the metallic container,

14. The corrodible system of claim 1, wherein the refillable non-corrosive hollow porous tube includes a first member and a second member, wherein the first member is mounted at an angle to a top surface of the metallic container and the second member is mounted at an angle to a wall of the metallic container.

15. The corrodible system of claim 1, wherein the refillable non-corrosive hollow porous tube is allowed to curl and rest on an inner bottom surface of the metallic container.

16. The corrodible system of claim 1, wherein the anodic material is in the form of granules, cut wires, or small balls, wherein a size of the granules, the cut wires, or the small balls is greater than a diameter of one of the pores of the refillable non-corrosive hollow porous tube,

17. The corrodible system of claim 16, wherein the diameter of the pore is between one micron and several millimeters.

18. The corrodible system of claim 1, wherein the anodic material is refilled without disturbing a position of the refillable non-corrosive hollow porous tube.

19. The corrodible system of claim 1, wherein an outer diameter of the refillable anode tube is at least ½ inches less than an outside diameter of the metallic container.

* * * * *